US006368070B1

(12) United States Patent
Takai

(10) Patent No.: US 6,368,070 B1
(45) Date of Patent: Apr. 9, 2002

(54) VARIABLE DISPLACEMENT COMPRESSOR

(75) Inventor: Kazuhiko Takai, Gunma (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/604,314

(22) Filed: Jun. 27, 2000

(30) Foreign Application Priority Data

Jun. 28, 1999 (JP) ..... 11-180981

(51) Int. Cl.[7] ..... F04B 1/29
(52) U.S. Cl. ..... 417/222.2
(58) Field of Search ..... 92/71; 417/222.2, 417/269

(56) References Cited

U.S. PATENT DOCUMENTS 4,664,604 A * 5/1987 Terauchi ..... 417/222.2
4,842,488 A * 6/1989 Terauchi ..... 417/269
4,936,752 A * 6/1990 Terauchi ..... 417/222.2
5,051,067 A * 9/1991 Terauchi ..... 417/222.2

* cited by examiner

*Primary Examiner*—Michael Koczo
(74) *Attorney, Agent, or Firm*—Baker Botts L.L.P.

(57) ABSTRACT

A variable displacement compressor includes a cylinder block having cylinder bores and a center bore, a drive shaft extending into the center bore through a crank chamber, an adjusting screw threaded into the center bore for axially supporting one end of the drive shaft via a thrust bearing and adjusting an axial gap of the thrust bearing, a plurality of pistons provided in the cylinder bores and moved reciprocally with the rotation of an inclined plate, and a belleville spring interposed between the thrust bearing and the adjusting screw. The adjusted spring force of the belleville spring is always added to an axial force applied to the drive shaft. The repeat of contact/release between the rotor and the thrust bearing, that is caused by the periodic increase/decrease of the compression reactive force, is prevented, and the axial vibration of the drive shaft is prevented.

1 Claim, 2 Drawing Sheets

VARIABLE DISPLACEMENT COMPRESSOR

BACKGROUND OF THE INVENTION

1. Field of the Invention

The present invention relates to a variable displacement compressor, and more specifically, to a variable displacement compressor with an improved structure for suppressing axial vibration of a drive shaft.

2. Description of Related Art

Variable displacement compressors, particularly, variable displacement inclined plate compressors, are known in the art. For example, a known structure of a variable displacement inclined plate compressor is constructed as depicted in FIG. 2. In FIG. 2, variable displacement inclined plate compressor 1' has cylindrical housing 2, front end plate 3 closing the front end of housing 2, and cylinder head 4 closing the rear end of housing 2. Valve plate 5 is interposed between the rear end of housing 2 and cylinder head 4. Cylinder block 6 is disposed in the rear half of housing 2. A plurality of cylinder bores 7, center bore 8, and communication path 9, are formed in cylinder block 6. Cylinder bores 7 are arranged radially about a center axis of the compressor at even radial intervals. Cylinder bores 7 extend in a front/rear direction. The front half of housing 2 forms crank chamber 10.

Drive shaft 11 extends into housing 2 in the front/rear direction through front end plate 3. The rear end portion of drive shaft 11 is inserted into center bore 8. Drive shaft 11 is rotatably supported by front end plate 3 via radial bearing 12 and by cylinder block 6 via radial bearing 13. The rear end of drive shaft 11 is axially supported by thrust bearing 14 and adjusting screw 15' threaded into center bore 8. Axial gaps of thrust bearing 14 and thrust bearing 17, which are described in detail later, are adjusted by controlling the degree to which adjusting screw 15' is threaded into center bore 8, which thereby, adjusts the axial loads applied to thrust bearings 14 and 17. Lip seal 34 is disposed at a front side of radial bearing 12.

Rotor 16 is disposed in crank chamber 10 and fixed to drive shaft 11. Rotor 16 is supported in the axial direction of drive shaft 11 by front end plate 3 via thrust bearing 17. Arm portion 16*a* is formed by the rear end portion of rotor 16. Slot 16*b* is defined in arm portion 16*a*. Spherical bush 18 is slidably fitted onto drive shaft 11 at a rear position of rotor 16, in the axial direction of drive shaft 11. Coil spring 19 is interposed between rotor 16 and spherical bush 18. Disc-type inclined plate 20 is provided slidably and rotatably on spherical bush 18.

Arm portion 20*a* is provided on one side of inclined plate 20. Arm portion 20*a* extends toward selvage portion 16*a* of rotor 16. Arm portion 20*a* has hole 20*b* defined at a position corresponding to slot 16*b*. Pin 21 is inserted into slot 16*b* and hole 20*b* to connect rotor 16 and inclined plate 20 while allowing the variable inclination of inclined plate 20.

A pair of semi-spherical sliding shoes 22 are provided slidably on both surfaces of a radial outer portion of inclined plate 20. A plurality of pairs of semi-spherical sliding shoes 22 are disposed radially about inclined plate 20 at even intervals. Each pair of semi-spherical sliding shoes 22 are held slidably in each piston rod 23. Each piston rod 23 extends into a corresponding cylinder bore 7 in the rear direction, and forms a piston 24 slidably inserted into the corresponding cylinder bore 7.

Suction port 25 and discharge port 26 are provided on valve plate 5 in correspondence with each cylinder bore 7.

A suction valve (not shown) and a discharge valve (not shown) are provided for controlling the flow of fluid through suction port 25 and discharge port 26, respectively. Suction chamber 27, communicating with suction port 25, and discharge chamber 28, communicating with discharge port 26, are formed in cylinder head 4. Suction chamber 27 communicates with inlet port 29. Discharge chamber 28 communicates with outlet port 30.

Communication path 9, formed in cylinder block 6, communicates with crank chamber 10 and suction chamber 27. Bellows 31 is disposed in communication path 9. Electromagnetic clutch 32 is provided at a front position of front end plate 3.

In variable displacement inclined plate compressor 1', an external driving force is transmitted from an external drive source (not shown), via electromagnetic clutch 32, to rotate drive shaft 11. Rotor 16 rotates synchronously with the rotation of drive shaft 11. Inclined plate 20 rotates synchronously with the rotation of rotor 16. A pair of sliding shoes 22 slide on the surfaces of the radial outer portion of rotated inclined plate 20, while moving reciprocally in the front/rear direction. Piston rod 23, which holds sliding shoes 22, and piston 24, which is formed on the rear end portion of piston rod 23, also move reciprocally in the front/rear direction in cylinder bore 7. By the reciprocal movement of each piston 23, fluid introduced into suction chamber 27 from inlet port 29 is drawn into cylinder bore 7 through suction port 25. This fluid then is compressed in cylinder bore 7 and discharged into discharge chamber 28 through discharge port 26, and then is discharged to an external fluid circuit (not shown) through outlet port 30.

In variable displacement inclined plate compressor 1', when the thermal load of the external fluid circuit increases, the pressures in suction chamber 27 and communication path 9 increase, bellows 31 shrinks, and crank chamber 10 communicates with communication path 9. Blowby gas, that has leaked from cylinder bore 7 into crank chamber 10 through the sliding portion between piston 24 and cylinder bore 7, is released into suction chamber 27 through communication path 9. As a result, the pressure in crank chamber 10 becomes nearly equal to the pressure in suction chamber 27.

Referring to FIG. 2, in the compression process, moment Ml, which causes inclined plate 20 to rotate in the clockwise direction around pin 21, is generated by the compression reactive force applied to piston 24. Oppositely, moment M2, which causes inclined plate 20 to rotate in the counterclockwise direction around pin 21, is generated by the expanding force of coil spring 19. Therefore, when the thermal load of the external fluid circuit and the pressure in suction chamber 27 increase, the compression reactive force increases to a condition of M1>M2. Consequently, inclined plate 20 rotates clockwise, the stroke of piston 24 increases, and the displacement of variable displacement inclined plate compressor 1' increases.

When the thermal load of the external fluid circuit decreases, the pressures in suction chamber 27 and communication path 9 decrease, bellows 31 expands, and the communication between crank chamber 10 and communication path 9 is interrupted. The pressure in crank chamber 10 becomes higher than the pressure in suction chamber 27 due to blowby gas introduced into crank chamber 10. Consequently, during the compression process, moment M3, which causes inclined plate 20 to rotate in the counterclockwise direction around pin 21, is generated by the pressure of blowby gas in crank chamber 10. When the thermal load of the external fluid circuit and the pressure in suction chamber 27 decrease, the compression reactive force decreases, such that M1<M2+M3. Consequently, inclined plate 20 rotates counter-clockwise, the stroke of piston 24 decreases, and the displacement of variable displacement inclined plate compressor 1' decreases.

In known variable displacement inclined plate compressor 1', when compressor 1' is operated at a low thermal load condition, (a) a resultant axial force, due to the pressure of blowby gas in crank chamber 10, is applied to drive shaft 11 via piston 24, and (b) a resultant force, due to the compression reactive force, is applied to drive shaft 11 via piston 24, balance as time averaged values. In such a condition, the contact/release between rotor 16 and thrust bearing 17 is repeated and drive shaft 11 vibrates, in its axial direction, synchronously with the periodic increase/decrease of the compression reactive force caused by the repeated suction/compression processes. Thus, the contact/release between rotor 16 and thrust bearing 17 and the axial vibration of drive shaft 11 produce noise.

SUMMARY OF THE INVENTION

Accordingly, it is an object of the present invention to provide an improved structure for a variable displacement compressor that prevents an axial vibration of a drive shaft even when operated at a low thermal load condition.

To achieve the foregoing and other objects, a variable displacement compressor according to the present invention is provided. The variable displacement compressor comprises a cylinder block having a plurality of cylinder bores and a center bore, a drive shaft extending through a crank chamber, wherein one end portion of the drive shaft is inserted into the center bore and is rotatably supported in the center bore via a radial bearing. An adjusting screw is threaded into the center bore to axially support one end of the drive shaft, via a thrust bearing, and to adjust an axial gap of the thrust bearing. An inclined plate is provided around the drive shaft and rotated synchronously with the drive shaft at an inclined angle, variably controlled relative to an axis of the drive shaft. A plurality of pistons are provided in the cylinder bores and moved reciprocally with the rotation of the inclined plate. A cylinder head is provided on an axial end of the cylinder block via a valve plate and has therein a suction chamber and a discharge chamber for fluid. Compressor displacement is controlled by the inclined angle of the inclined plate, or the pressure in the crank chamber, which thereby controls the stroke of the pistons. The compressor comprises a belleville spring interposed between the thrust bearing and the adjusting screw. recessed portion may be defined on the adjusting screw, and the belleville spring may be in the recessed portion.

In the variable displacement compressor, threading the adjusting screw, adjusts the axial gap of the thrust bearing and compresses the belleville spring, which applies a reactive force of the compressed belleville spring to the drive shaft via the thrust bearing. The reactive force of the belleville spring acts in the same direction as that applied with the compression reactive force in the compressor, relative to the drive shaft. Therefore, if the elastic modulus of the belleville spring and the threading degree of the adjusting screw are set at adequate values, and the reactive force of the belleville spring is set at a proper value, even when the compressor is operated at a low thermal load condition, the sum of the time averaged resultant force of the compression reactive force and the reactive force of the belleville spring, that is applied to the drive shaft, is greater than the resultant force of the axial force due to blowby gas in the crank chamber that is applied to the drive shaft. Consequently, the vibration of the drive shaft, that is generated synchronously with the periodic increase/decrease of the compression reactive force due to the repeated suction/compression processes, is prevented.

In the present invention, a belleville spring is used to obtain such an advantage. Increase of the axial dimension of the compressor is suppressed by interposing the belleville spring between the thrust bearing and the adjusting screw, as compared to interposing a coil spring therebetween.

In a preferred embodiment of the present invention, a recessed portion is defined on the adjusting screw, and the belleville spring is contained in the recessed portion. Therefore, increase of the axial dimension of the compressor is further suppressed.

Further objects, features, and advantages of the present invention will be understood from the following detailed description of a preferred embodiment of the present invention with reference to the accompanying figures.

BRIEF DESCRIPTION OF THE DRAWINGS

An embodiment of the invention is now described with reference to the accompanying figures, which are given by way of example only, and is not intended to limit the present invention.

DETAILED DESCRIPTION OF PREFERRED EMBODIMENTS

Figure 1:
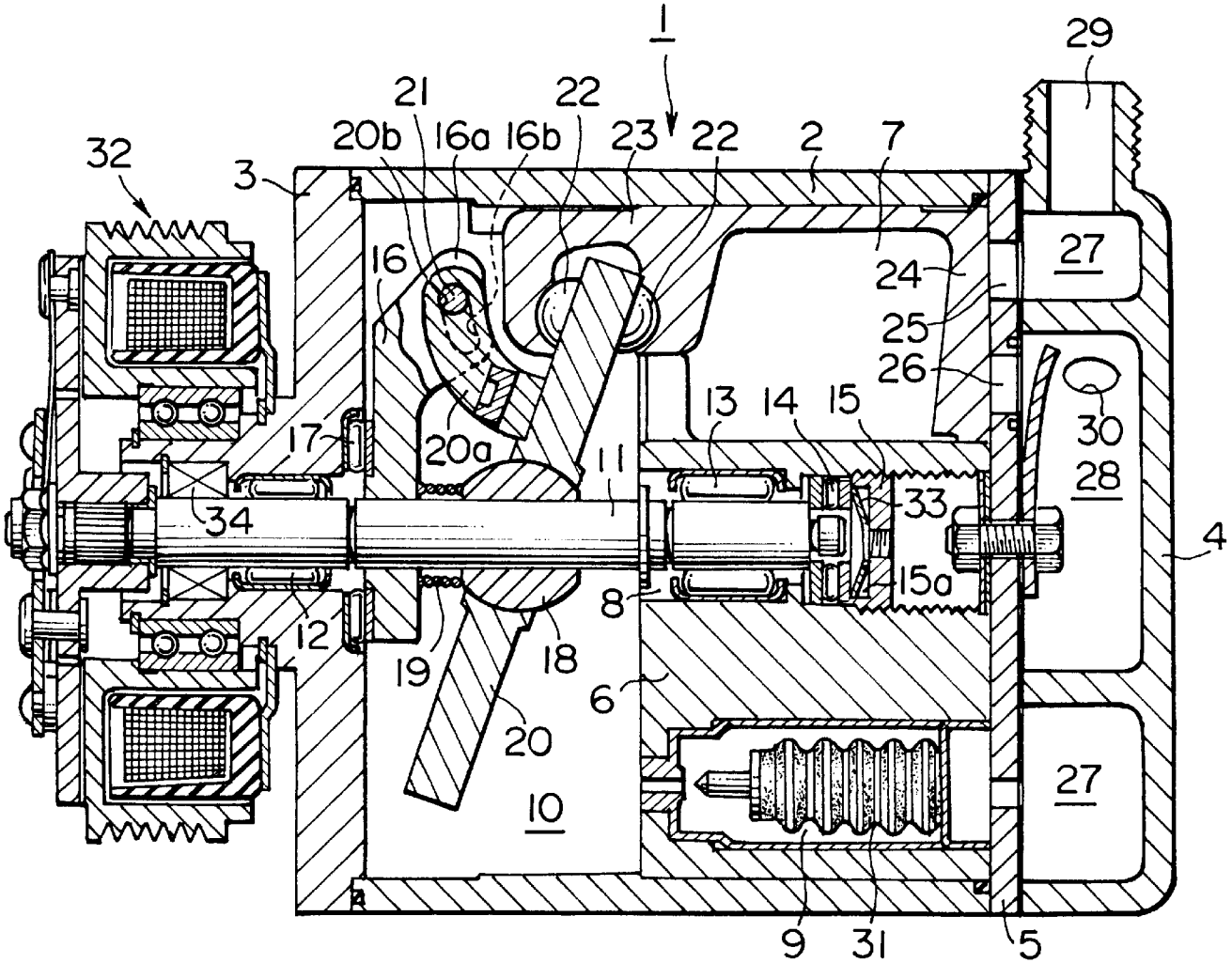
FIG. 1 is a vertical sectional view of a variable displacement compressor according to an embodiment of the present invention.
Figure 2:
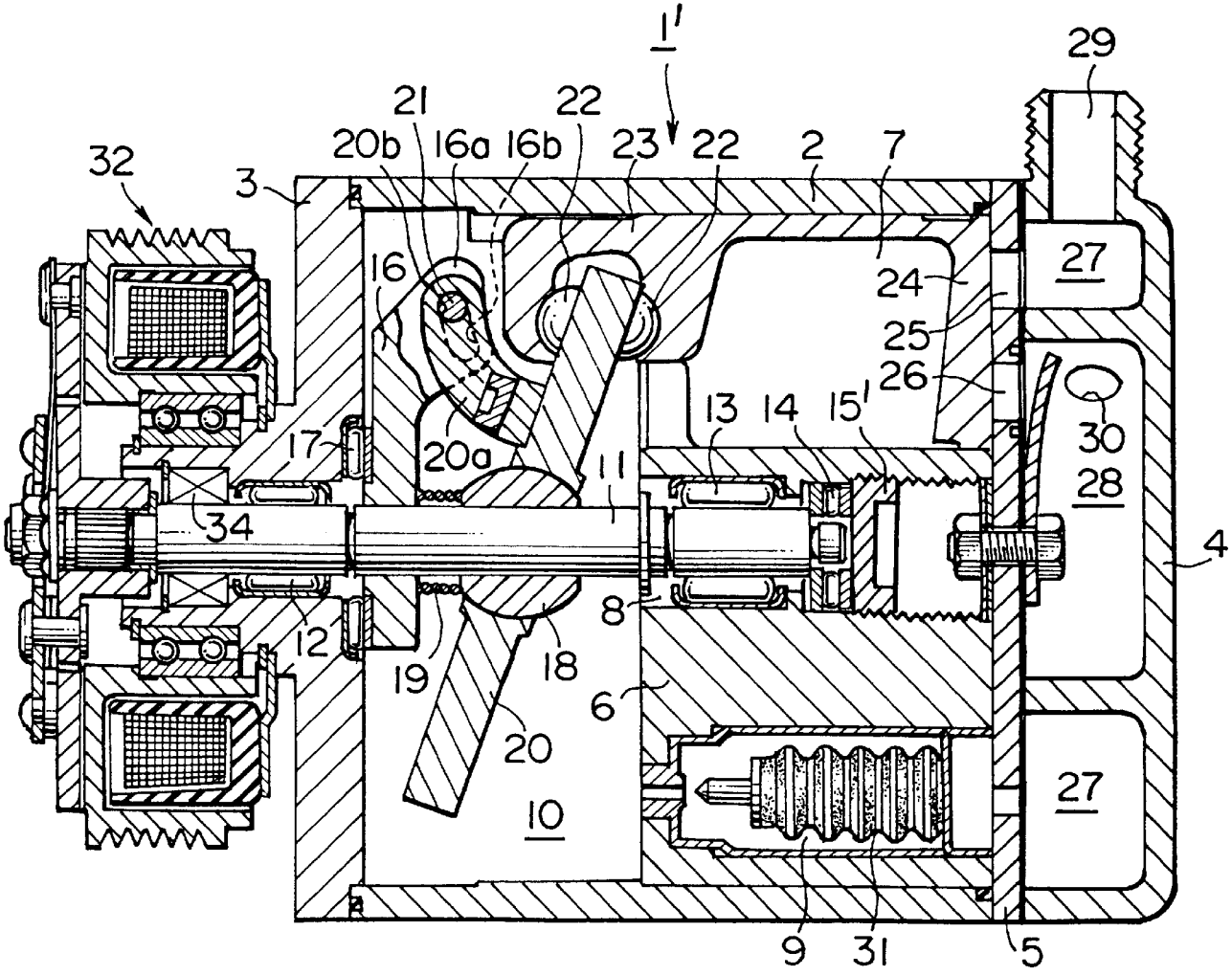
FIG. 2 PRIOR ART
FIG. 2 is a vertical sectional view of a known variable displacement compressor.

A variable displacement compressor according to an embodiment of the present invention is depicted in FIG. 1. The embodiment of the present invention described below will be explained only with respect to portions which differ from those of the known compressor, as depicted in FIG. 2. The same reference numerals in FIG. 2 are used in FIG. 1, to omit redundant explanation.

Referring to FIG. 1, in variable displacement compressor 1, adjusting screw 15 is threaded into center bore 8 to axially support one end of drive shaft 11 via thrust bearing 14. Belleville spring 33 is interposed between thrust bearing 14 and adjusting screw 15. Recessed portion 15a is defined on a side of adjusting screw 15. Belleville spring 33 is contained in recessed portion 15*a*.

In variable displacement compressor 1, axial gaps of thrust bearings 14 and 17 are adjusted by controlling the degree to which adjusting screw 15 is threaded into center bore 8. Consequently, the axial loads applied to thrust bearings 14 and 17 are adjusted and belleville spring 33 is compressed and elastically deformed. Therefore, the reactive force of belleville spring 33 is applied to drive shaft 11 via thrust bearing 14. Because the reactive force of belleville spring 33 acts to drive shaft 11 in the same direction as that of the compression reactive force of compressor 1; by adequately setting the elastic modulus of belleville spring 33, adequately controlling the threading degree of adjusting screw 15, and properly setting the reactive force of belleville spring 33, the sum of the time averaged resultant force of the compression reactive force and the reactive force of belleville spring 33 applied to drive shaft 11 is maintained at a value greater than the axial resultant force applied to drive shaft 11 due to the pressure of blowby gas in crank chamber 10. This condition is achieved even when compressor 1 is operated at a low thermal load condition.

In such a condition, even if the compression reactive force periodically increases and decreases, accompanying with repeated suction/compression processes, a force directed in the lefthand direction in FIG. 1 is applied to drive shaft 11. Therefore, rotor 16, fixed to drive shaft 11, is pressed to thrust bearing 17. Consequently, the repeat of contact/release between rotor 16 and thrust bearing 17, that is caused by the synchronous periodic increase/decrease of the compression reactive force, is prevented, and the axial vibration of drive shaft 11 is prevented.

Because belleville spring 33 is interposed between thrust bearing 14 and adjusting screw 15, increase in the axial dimension of compressor 1 is suppressed, as compared to the case of interposing a coil spring.

Further, because belleville spring 33 is contained in recessed portion 15*a*, defined on adjusting screw 15, increase of the axial dimension of compressor 1 is further suppressed. However, the formation of recessed portion 15*a* may be omitted.

Although variable displacement compressor 1 is constructed, such that piston 24 and piston rod 23 are slidably connected to inclined plate 20 via a pair of sliding shoes 22. In the embodiment, it also may be constructed as a non-rotatable wobble plate slidably engaging an inclined plate and a piston connected to the wobble plate.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A variable displacement compressor comprising: a cylinder block having a plurality of cylinder bores and a center bore, a drive shaft extending through a crank chamber, wherein one end portion of said drive shaft is inserted into said center bore and rotatably supported in said center bore via a radial bearing, an adjusting screw threaded into said center bore for axially supporting one end of said drive shaft via a thrust bearing and adjusting an axial gap of said thrust bearing, an inclined plate provided around said drive shaft and rotated synchronously with said drive shaft at an inclined angle variably controlled relative to an axis of said drive shaft, a plurality of pistons provided in said cylinder bores and moved reciprocally accompanying with the rotation of said inclined plate, a cylinder head provided on an axial end of said cylinder block via a valve plate and having therein a suction chamber and a discharge chamber for fluid, a displacement for compression of said compressor being controlled by controlling said inclined angle of said inclined plate by adjusting a pressure in said crank chamber, thereby controlling a stroke of said pistons, and a belleville spring interposed between said thrust bearing and said adjusting screw, wherein a recessed portion is defined on said adjusting screw for containing said belleville spring in said recessed portion.

* * * * *